US007661379B2

(12) United States Patent
Pettersson et al.

(10) Patent No.: US 7,661,379 B2
(45) Date of Patent: Feb. 16, 2010

(54) PROPULSION AND STEERING ARRANGEMENT FOR A SHIP

(75) Inventors: Göran Pettersson, Kristinehamn (SE); Kåre Krøvel Nerland, Ålesund (NO)

(73) Assignee: Rolls-Royce Aktiebolag, Kristinehamn (SE)

( * ) Notice: Subject to any disclaimer, the term of this patent is extended or adjusted under 35 U.S.C. 154(b) by 141 days.

(21) Appl. No.: 11/911,083

(22) PCT Filed: Mar. 29, 2006

(86) PCT No.: PCT/SE2006/050048

§ 371 (c)(1),
(2), (4) Date: Mar. 28, 2008

(87) PCT Pub. No.: WO2006/112787

PCT Pub. Date: Oct. 26, 2006

(65) Prior Publication Data

US 2009/0120343 A1 May 14, 2009

(30) Foreign Application Priority Data

Apr. 20, 2005 (SE) ..... 0500895
Oct. 31, 2005 (SE) ..... 0502423

(51) Int. Cl.

| | |
|---|---|
| ***B63H 25/06*** | (2006.01) |
| *B63H 25/42* | (2006.01) |
| *B63H 1/16* | (2006.01) |
| *B63H 5/15* | (2006.01) |

(52) U.S. Cl. ..... 114/162; 440/51; 440/67

(58) Field of Classification Search ..... 440/51, 440/67; 114/162

See application file for complete search history.

(56) References Cited

U.S. PATENT DOCUMENTS

| | | | | |
|---|---|---|---|---|
| 666,077 | A * | 1/1901 | Walters | 440/51 |
| 5,456,200 | A | 10/1995 | Shen | |
| 5,752,865 | A * | 5/1998 | Ishii et al. | 440/67 |

FOREIGN PATENT DOCUMENTS

| | | | |
|---|---|---|---|
| DE | 3 632 590 | A1 | 4/1988 |
| EP | 1 394 037 | A1 | 3/2004 |
| GB | 762445 | A | 11/1956 |
| GB | 2111007 | A | 6/1983 |
| JP | 6 305 487 | A | 11/1994 |
| WO | WO 97/11878 | A1 | 4/1997 |

OTHER PUBLICATIONS

International Search Report Dated Jul. 19, 2006.

* cited by examiner

*Primary Examiner*—Daniel V Venne
(74) *Attorney, Agent, or Firm*—Plumsea Law Group, LLC

(57) ABSTRACT

The invention relates to a steering and propulsion arrangement for a ship. The inventive steering and propulsion arrangement comprises a screw propeller 3 and a rudder 6. A streamlined propulsion bulb 10 is made integral with or fixedly connected to the rudder. The invention also relates to a ship 2 provided with the inventive arrangement.

15 Claims, 6 Drawing Sheets

PROPULSION AND STEERING ARRANGEMENT FOR A SHIP

FIELD OF THE INVENTION

The present invention relates to an arrangement for steering and propulsion of a ship. The arrangement is of the kind that comprises a propeller, a rudder and a bulb located behind the propeller. The invention also relates to a ship provided with such an arrangement.

BACKGROUND OF THE INVENTION

The most common means for propelling ships is the screw propeller wherein the axis of rotation of the blades is disposed along the direction of movement of the ship. To reduce fuel consumption, the efficiency of the propeller should be as high as possible. In this context, the efficiency of a propeller that is mounted on a ship is defined as the ratio between the power needed to propel the ship forward and the power needed to simply drag the ship forward. Typically, the efficiency of a propeller is 60-70%. Since fuel consumption is directly dependent on the efficiency of the propeller, any improvement in the efficiency results in a corresponding reduction of the fuel consumption.

In order to improve the efficiency of propellers, it has been suggested that the propeller be combined with a streamlined body arranged behind the propeller and coaxial with the propeller. Such a streamlined body is sometimes referred to as a Costa-bulb, propulsion bulb or simply bulb. Such a propulsion bulb is disclosed in, for example, British patent specification GB 762,445. That document discloses an arrangement where a propeller is mounted on a ship in front of a rudder having a rudder post. A bulb is placed behind the propeller and a supporting member for the bulb is formed by the rudder post. It has also been suggested in WO 97/11878 that a torpedo-shaped body can be placed behind the propeller. The torpedo-shaped body is described as being suspended in the rudder horn and unable to be swung relative to the ship.

For a ship, it is also desirable that the manoeuvrability is as good as possible. In this context, manoeuvrability is defined as the side force that can be accomplished with a certain angular displacement of the rudder.

It is an object of the present invention to provide an arrangement for steering and propulsion of a ship which has an improved efficiency. It is a further object of the invention to provide an arrangement for steering and propulsion that has an improved manoeuvrability without increased steering gear torque.

DISCLOSURE OF THE INVENTION

According to the invention, a propulsion and steering arrangement for a ship comprises a rotary propeller with a hub and one or several propeller blades. Preferably, the propeller has at least two propeller blades. A turnable rudder is arranged behind the propeller in the direction of movement of the ship. The rudder is twisted, i.e. curved instead of planar. A streamlined propulsion bulb is integral with the rudder and placed behind the propeller such that sea water pressed backwards by the propeller will flow around the bulb. The front end of the bulb is separated from the propeller and its hub by a gap. The gap between the bulb and the propeller is bridged by a hub cap. In preferred embodiments of the invention, the hub cap meets the bulb at a location between the propeller and the part of the bulb where the bulb reaches it maximum diameter. The hub cap and the front end of the bulb are designed keep the distance between the bulb and the cap constant when the rudder is turned.

The maximum diameter of the bulb can be equal to the diameter of the propeller hub. However, in advantageous embodiments of the invention, the maximum diameter of the bulb is larger than the diameter of the propeller hub. The maximum diameter of the bulb can be from 1% to 40% greater than the diameter of the propeller hub, and preferably 20% greater.

The bulb may extend along an axis parallel with or coaxial with the axis of rotation of the propeller but, in an alternative embodiment, it can also extend along an axis that defines an acute angle with the axis of rotation of the propeller. In the alternative embodiment, the rear end of the bulb may be at a level above the front end of the bulb such that the angle between the bulb and the propeller axis is 1°-14°. Preferably, the angle between the bulb and the propeller axis is 3°-5°.

In some embodiments of the invention, the twist of the rudder decreases from a front end adjacent the propeller to a rear end which is a distal end in relation to the propeller such that the rear end of the rudder extends along a straight line. In other embodiments, at least a part of the rudder is continuously twisted from a front end of the rudder to a rear end of the rudder Preferably, the bulb divides the rudder in an upper part and a lower part that are twisted in opposite directions in relation to each other. In all embodiments, the twist of the rudder is greatest in the area of the bulb and decreases with the distance from the bulb. Preferably, the twist decreases linearly with the distance from the bulb. The maximum twist of the rudder may be up to 15°.

BRIEF DESCRIPTION OF THE DRAWINGS

FIG. 11 shows a cross-sectional view of the bulb and the hub cap according to one embodiment.

DETAILED DISCLOSURE OF THE INVENTION

Figure 1:
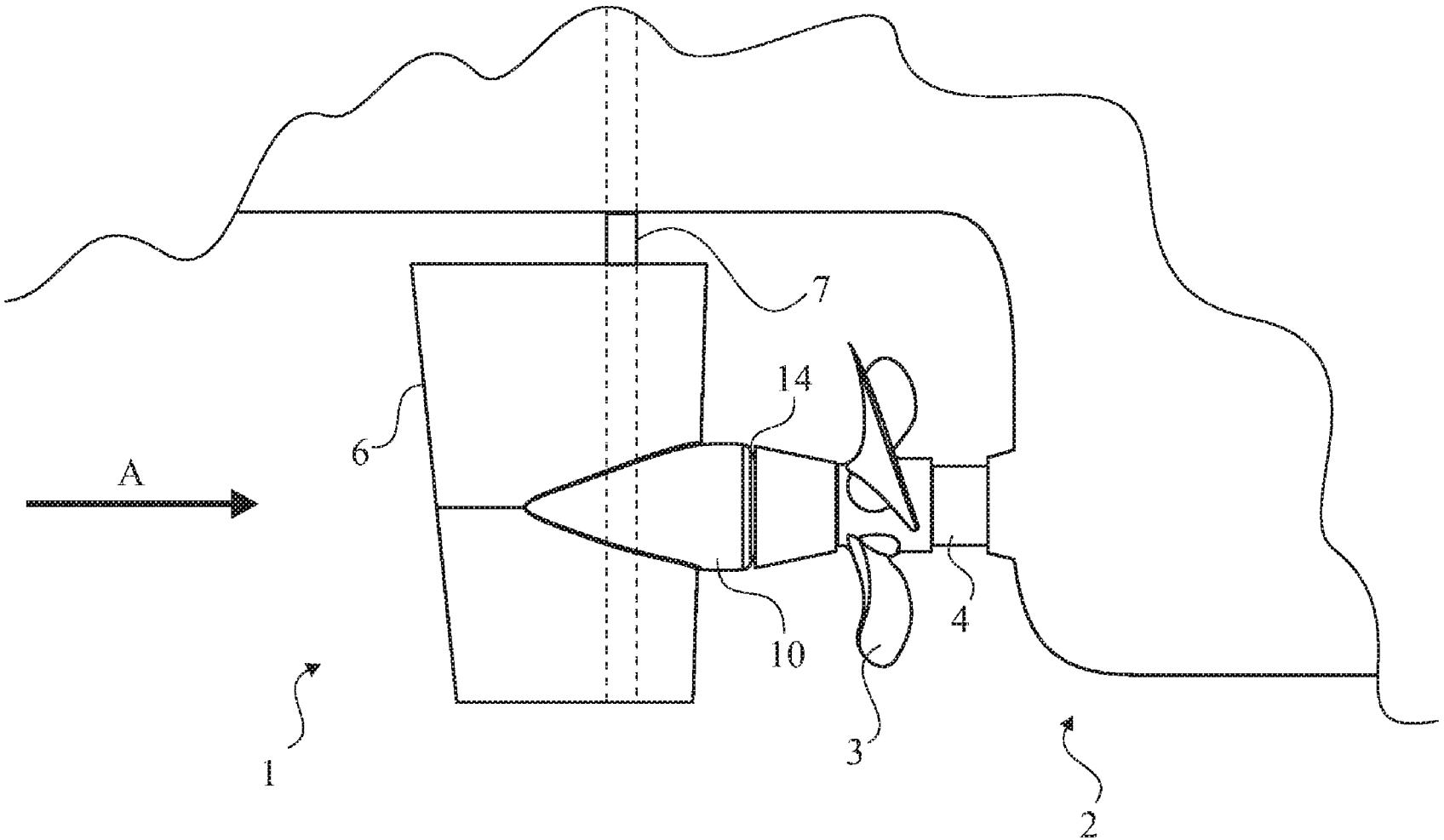
FIG. 1 shows an arrangement according to the present invention arranged on the stem of a ship.

The invention shall now be explained in greater detail with reference to FIG. 1 and FIG. 2. As can be seen in FIG. 1, the inventive arrangement 1 for steering and propulsion of a ship 2 is mounted on the aft portion of a ship 2. The inventive arrangement comprises a rotary propeller 3 mounted on a drive shaft 4. When propeller is driven by drive shaft 4, the propeller 3 will propel the ship 2 forwards in the direction of arrow A (it should be understood that the drive can also be reversed to cause the ship to go astern). When the ship 2 is propelled forwards by the propeller 3, water that has passed the propeller 3 will travel backwards against a turnable rudder 6 that is located downstream of the propeller 3, i.e. behind the propeller 3. In this context, the terms "downstream" and "behind"should be understood with reference to the forward direction of movement of the ship (as indicated by the arrow A). The rudder 6 is mounted on a rudder stock 7 that can turn to control the position of the rudder 6.

Figure 2:
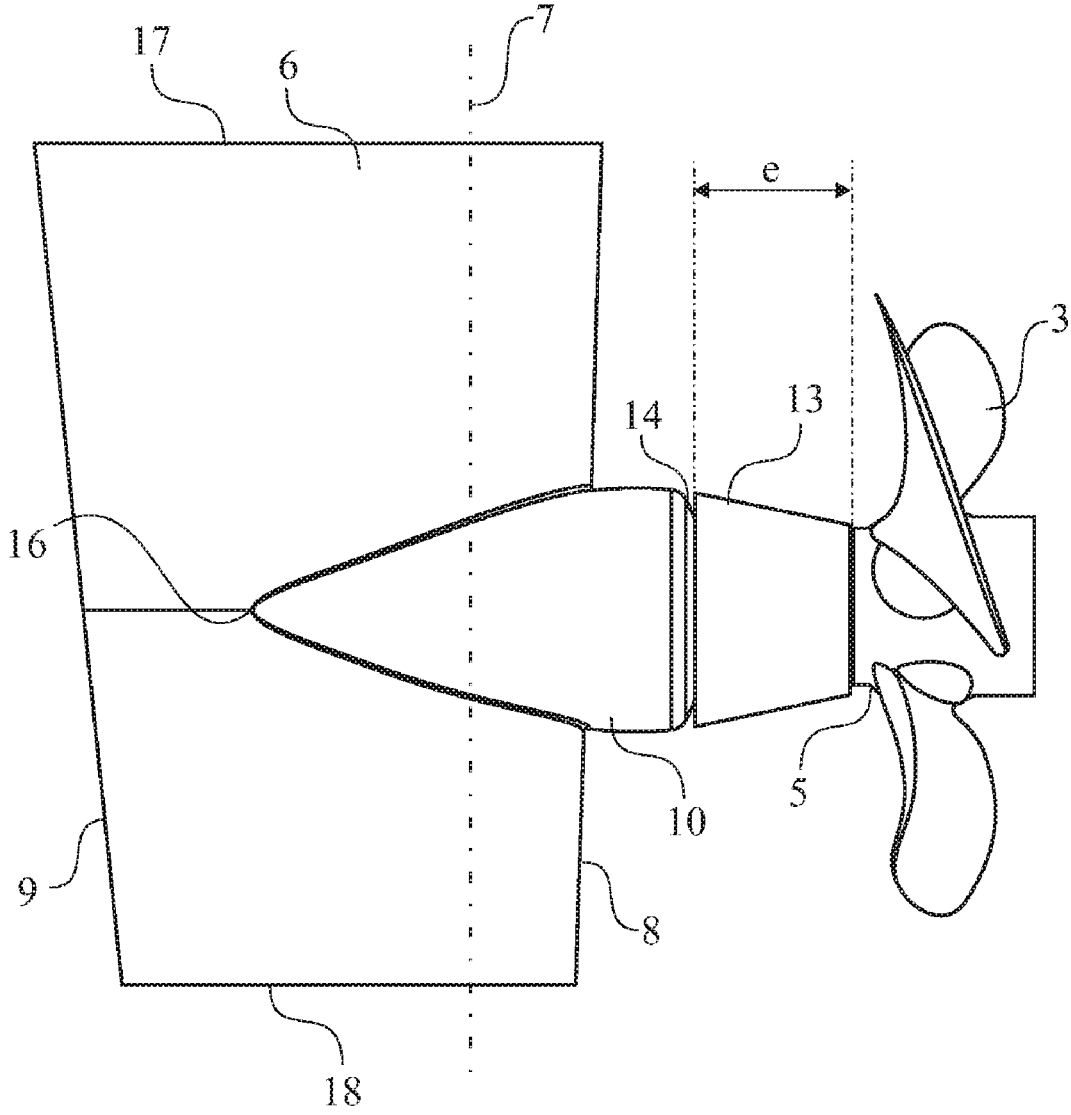
FIG. 2 shows in greater detail the arrangement of FIG. 1.

As indicated in FIG. 2, the propeller 3 has a hub 5 on which the propeller blades are mounted. In principle, the propeller 3 can have only one propeller blade but preferably it has at least two propeller blades. It can also have more than two blades. For example, it can have three blades or four blades.

A streamlined bulb 10 has been made integral with the rudder 6. When the propeller 3 is active, water from the propeller will flow over the bulb 10. When the water flows over the streamlined bulb 10, the efficiency of the propeller is increased. Without wishing to be bound by theory, it is believed that the bulb reduces rotational losses and cavitation behind the screw propeller 3 and that this is the reason for the increased efficiency. The bulb 10 is separated from the propeller 3 by a gap e. The inventors have found that, for maximum efficiency, this gap should be closed. To this end, the hub 5 of the propeller 3 has a hub cap 13 that bridges the gap e between the propeller 3 and the bulb 10. The hub cap 13 is integral with or fixedly connected to the hub 5. Hence, it rotates together with the hub 5. This increases the resistance between the water and the hub cap. As a result, the efficiency is somewhat reduced, albeit marginally. For this reason, the hub cap 13 should preferably be relatively short. On the other hand, it would not be desirable to reduce the length of the hub cap 13 to zero since that would make it necessary to increase the length of the bulb 10 in order to bridge the gap between the bulb 10 and the propeller. Since the bulb 10 is integral with the rudder, this would make it harder to turn the rudder 6. The length of the hub cap 13 must consequently be a compromise between partially opposite requirements.

Figure 8:
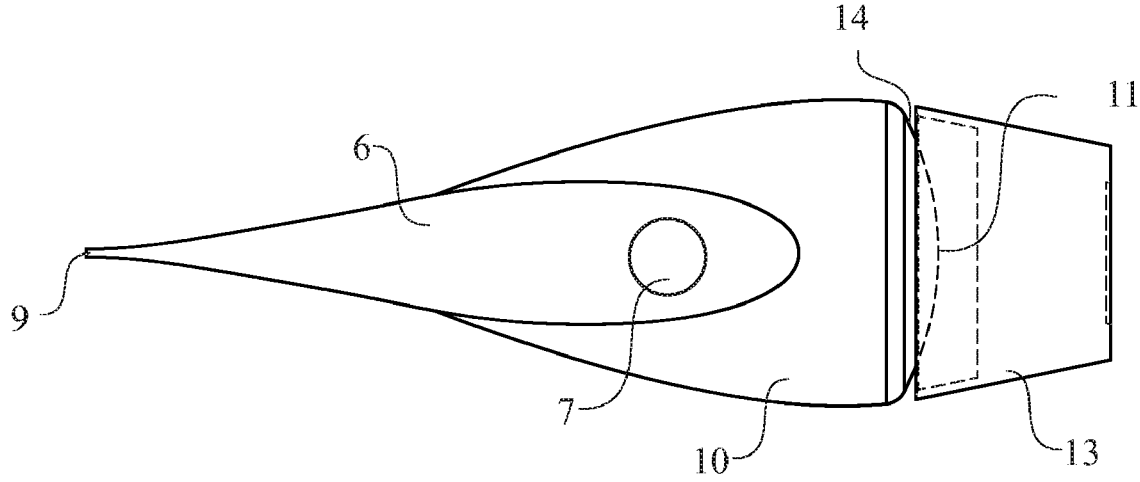
FIG. 8 shows the rudder and the hub cap from above when the rudder is in a neutral position.
Figure 9:
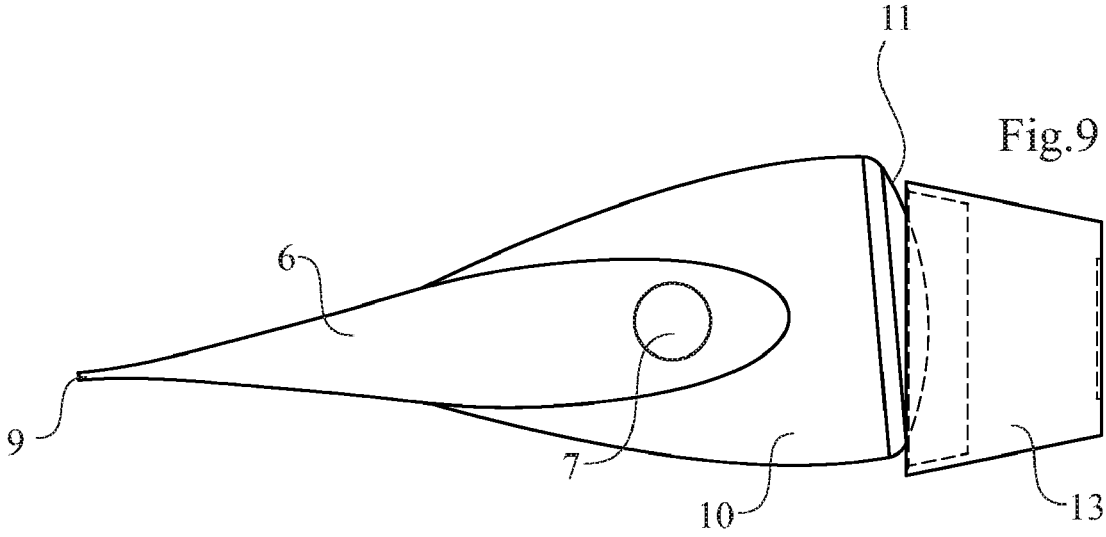
FIG. 9 shows a view of the rudder similar to FIG. 8 but with the rudder turned in order to cause the ship to change its direction of movement.

As indicated in FIGS. 2, 8 and 9, the hub cap 13 meets the upstream or forward end 11 of the bulb 10 at a transition 14 where the forward end 11 of the bulb 10 projects into a part of the hub cap 13. However, the bulb 10 does not need to actually contact the hub cap 13. In preferred embodiments, there is a small distance between the hub cap 13 and the forward end 11 of the bulb 10. As best seen in FIG. 8 and FIG. 9, the rudder 6 can turn. When the rudder 6 turns, it necessarily turns in relation to the hub cap 13. To avoid contact between the hub cap 13 and the bulb 10, the hub cap and the front end of the bulb 10 are designed keep the distance between the bulb 10 and the cap constant when the rudder 6 is turned. To achieve this effect, the forward end 11 of the bulb 10 may be curved and have a curvature corresponding to the distance from the rudder stock 7 to the forward end 11 of the bulb 10. While it should be clear from the foregoing that the bulb 10 should preferably not contact the hub cap 13, the hub cap 13 may still bridge the gap e since the bulb 10 projects into a part of the hub cap, In many realistic embodiments of the invention, the gap e may be about 15-25% of the propeller diameter (typical propeller diameters may be 2-6 m).

The hub cap 13 should preferably meet the bulb 10 at a location 14 between the propeller 3 and the part of the bulb 10 where the bulb 10 reaches it maximum diameter. It would be less preferable to make the transition coincide with the maximum diameter of the bulb 10. The reason is that the maximum diameter of the bulb coincides with the lowest water pressure. Consequently, if the transition 14 coincided with the maximum diameter of the bulb, this could generate an underpressure between the hub cap 13 and the bulb 10.

In preferred embodiments of the invention, the maximum diameter of the bulb 10 is 1%-40% greater than the diameter of the propeller hub 5. Experiments conducted by the inventors indicate that, when the maximum diameter of the bulb is 20% greater than the diameter of the propeller hub 5, the highest efficiency improvement is achieved.

The design of the rudder shall now be explained with reference to FIGS. 3-7. According to the invention, the rudder 6 is twisted such that has a curved surface. The twist of the rudder can be expressed as the angle β with which a part of the rudder 6 deviates from a vertical plane P when the rudder is in a neutral position, the vertical plane P being the plane defined by the axis of the rudder stock 7 and the axis of the drive shaft 4. The curvature or twist of the rudder 6 corresponds to the direction of rotation of the water propelled backwards by the propeller 3 when the propeller 3 drives the ship forward. The rudder is twisted in such a way as to meet the swirling water that flows against the rudder 6. The maximum twist of the rudder is to be found in the area around the bulb 10. The bulb 10 is located substantially coaxially with the propeller axis 4 or drive shaft 4 (for convenience, the same reference numeral 4 is used to designate both the drive shaft and the propeller axis since the propeller axis coincides with the drive shaft 4). For this reason, the rotational movement of the water will have different directions above and below the bulb. Therefore, the area immediately above the bulb 10 is twisted/curved in one direction while the area immediately below the bulb 10 is twisted/curved in the opposite direction. The twist of the rudder 6 achieves the effect that a part of the energy in the rotation water is recovered. This increases the efficiency.

Figure 3:
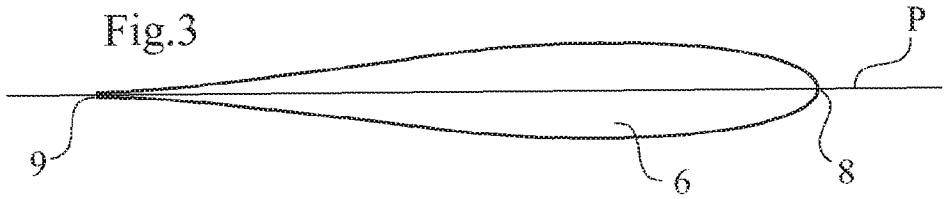
FIG. 3 shows a cross section of the rudder of FIG. 2.
Figure 4:
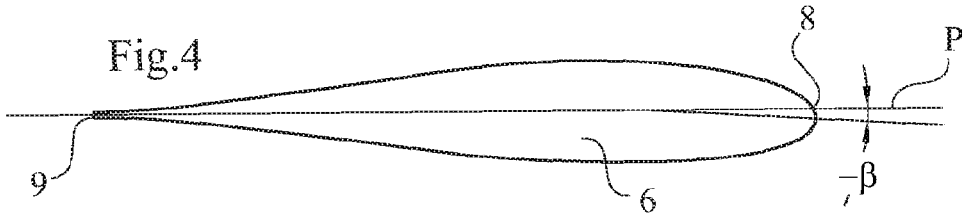
FIG. 4 shows a different cross section of the rudder.
Figure 5:
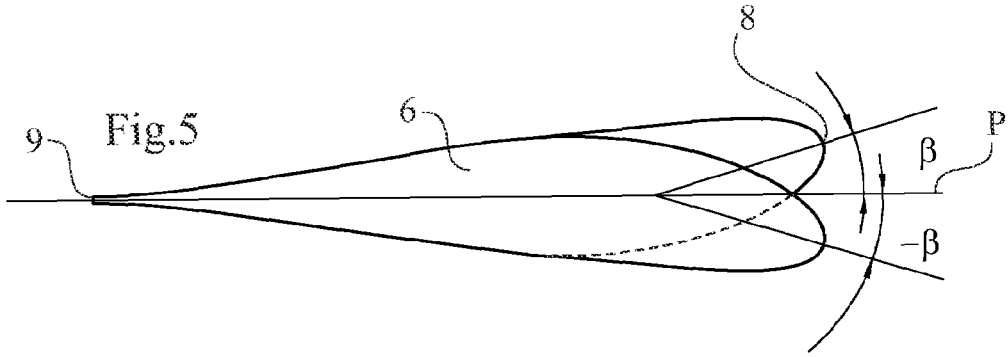
FIG. 5 shows the rudder as seen from above.

According to an embodiment shown in FIGS. 3-5, the twist of the rudder 6 decreases from a front end 8 adjacent the propeller 3 to a rear end 9 which is a distal end in relation to the propeller 3 such that the rear end 9 of the rudder 6 extends along a straight line. In the embodiment according to FIGS. 3-5, it is also so that twist of the rudder 6 is greatest in the area of the bulb 10 and decreases linearly with the distance from the bulb 10. FIG. 5 is a view from above of the rudder 6 where both the upper and the lower part of the twisted rudder 6 can be discerned. Here, it can be seen how the front end 8 of the rudder is twisted in one direction above the bulb 10 and in the opposite direction below the bulb 10. For simplicity, the bulb 10 is not shown in FIG. 5. As can be seen in FIG. 5, the rear end 9 of the rudder 6 is not twisted and the rear end 9 extends in a straight line. FIG. 3 shows a cross section of the rudder corresponding to an upper end 17 of the rudder 6. As can be seen in FIG. 3, the upper end 17 of the rudder 6 is not twisted. In FIG. 4, a cross section corresponding to a lower end 18 of the rudder 6 is shown. Here, there is still a certain remaining twist but the twist as represented by the angle β is here much smaller than the twist close to the bulb 10. The reason that the twist decreases with the distance from the bulb is that the rotation of the water varies with the distance from the propeller axis 4. The maximum twist of the rudder 6 immediately above or below the bulb 10 may be up to 15°.

Figure 6:
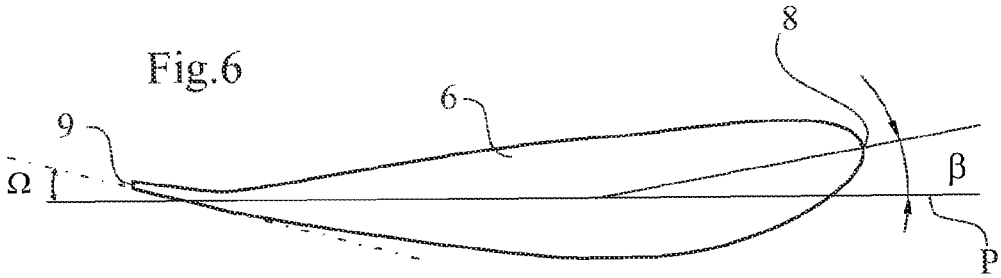
FIG. 6 shows a cross section according to an alternative embodiment.
Figure 7:
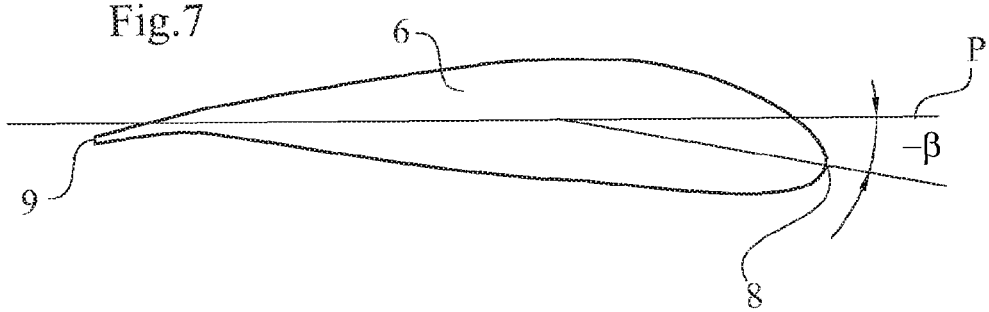
FIG. 7 another cross section from the same embodiment shown in FIG. 6.

A different embodiment of the rudder 6 will now be explained with reference to FIG. 6 and FIG. 7. In the embodiment according to FIG. 6 and FIG. 7, at least a part of the rudder 6 is continuously twisted from a front end 8 of the rudder 6 to a rear end 9 of the rudder. Hence, even when the rudder 6 is in a neutral position, the rear end 9 of the rudder 6 defines an angle Ω with a plane P that coincides with the propeller axis 4 (it should be understood that, while the symbol Ω has been used for the rear of the rudder, this symbol indicates the twist angle just like the symbol β). It should be understood that FIG. 6 represents a cross section of the rudder 6 immediately below the bulb 10 while FIG. 7 represents a cross section of the rudder immediately above the bulb 10. The continuously curved rudder has the effect that an even greater part of the kinetic energy in the water can be recovered. This results in improved efficiency.

With reference to FIGS. 3-7, it should also be made clear that the twist angle β does not have to be equally large above the bulb and below the bulb. In other words, the twist is not necessarily symmetrical around the bulb. In preferred embodiments of the invention, the twist angle β below the bulb 10 and at a certain distance from the bulb is actually smaller than the twist angle β at the same distance above the bulb 10. The reason is the following. The twist of the rudder 6 should correspond to the rotational movement of the water. The movement of the water has an axial component and a tangential component. Above the propeller axis, the water is closer to the hull of the ship 2. This tends to reduce the axial velocity of the water. As a result, the tangential component of the water movement downstream of the propeller 3 will be relatively larger in relation to the axial component. Below the propeller axis, the tangential component may be equally large in absolute terms but the axial component is also larger. Hence, the water meets the rudder 6 from a different angle.

Figure 10:
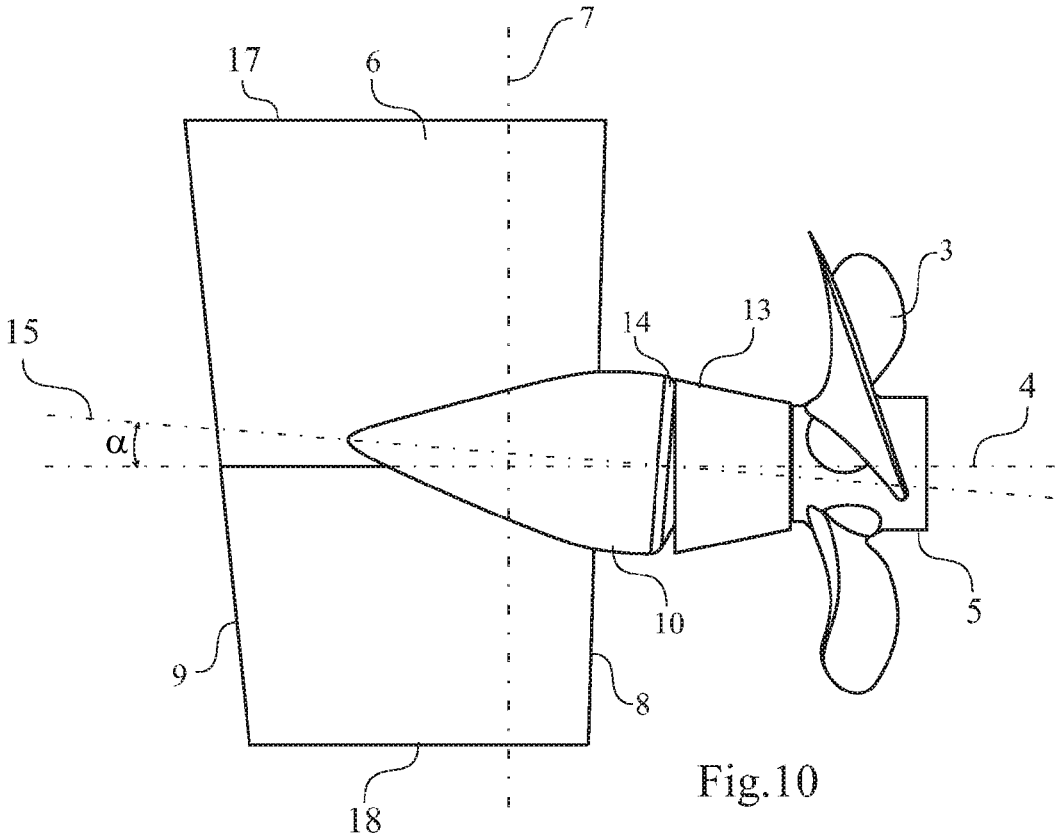
FIG. 10 is a view similar to FIG. 2 but showing another embodiment of the invention.
Figure 1:
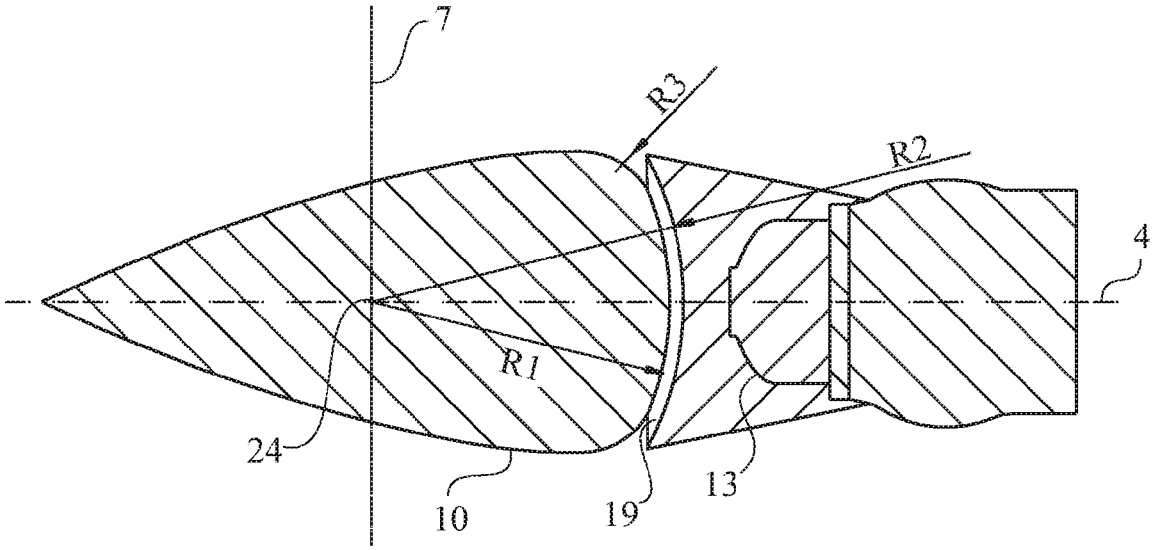

With regard to the bulb, a different embodiment will now be explained with reference to FIG. 10. In the embodiment shown in FIG. 1 and FIG. 2, the bulb 10 extends along an axis 15 parallel with or coaxial with the axis of rotation of the propeller 3. It should be understood that the bulb 10 is suitably a rotational symmetrical body (i.e. the bulb 10 is symmetrical around an axis of rotation). The axis 15 along which the bulb 10 extends should then be understood as the axis 15 of rotational symmetry. However, the inventors have found that even better results can be achieved in many cases if the bulb 10 extends along an axis 15 (in particular an axis 15 of rotational symmetry) that defines an acute angle with the axis of rotation of the propeller 3. The reason is that the flow of water from the propeller will often move slightly upwards from the propeller instead of going straight backwards. Hence, to make the water flow symmetrically around the bulb 10, the bulb 10 should be similarly inclined. In case the bulb 15 is not symmetrical around an axis of rotation, the axis 15 of the bulb should be thought of as a straight line from the most forward point of the bulb 10 to the most rearmost point of the bulb 10.

The rear end 16 of the bulb 10 is at a level above the front end of the bulb 10 and the angle between the bulb 10 and the propeller axis can realistically be in the range of 1°-14° and a suitable value in many applications can be 3°-5°.

Figure 12B:
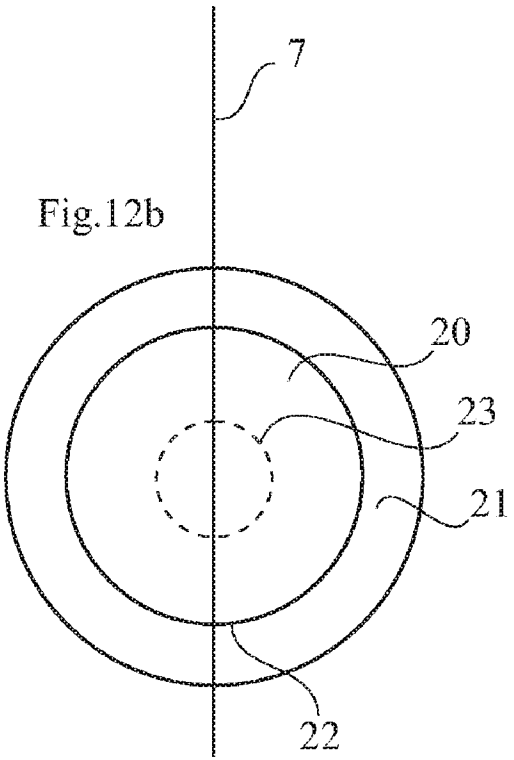
FIG. 12*b* is a front view of the bulb shown in FIG. 12*a*, i.e. as seen from the right in FIG. 12*a*.
Figure 12A:
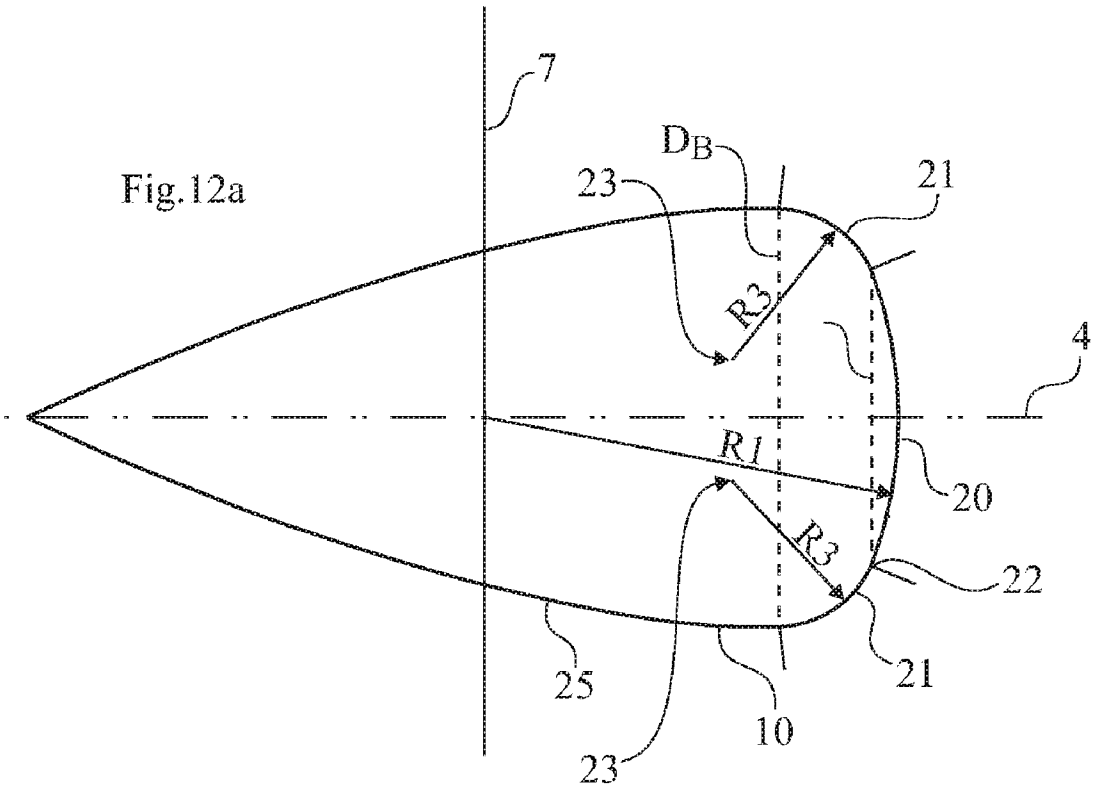
FIG. 12*a* shows the bulb of the embodiment shown in FIG. 11.

An other embodiment will now be explained with reference to FIG. 11 and FIGS. 12*a* and 12*b*. As indicated in FIG. 11, the hub cap 13 has a curved surface 19 adjacent the bulb 10. As indicated in FIG. 11 and FIG. 12*a*, the forward end 11 of bulb 10 has a radius of curvature $R_1$ that extends from an imaginary point 24 along the axis of the rudder stock 7. The curved surface 19 of the hub cap 13 has a radius of curvature $R_2$ that is somewhat larger than the radius of curvature $R_1$. The radius of curvature $R_2$ of the surface 19 should be understood as extending from the same imaginary point 24 as the radius of curvature R1 of the forward end 11 of the bulb 10. Consequently, the distance between the hub cap 13 and the bulb 10 can remain constant when the rudder turns. As best seen in FIG. 12*a* and FIG. 12*b*, it is only a central surface 20 on the forward end 11 of bulb 10 that has the radius of curvature $R_1$. The central surface 20 is surrounded by an annular surface 21 that has a radius of curvature $R_3$. In FIG. 12*a* and FIG. 12*b*, the reference numeral 22 designates the borderline between the central surface 20 and the surrounding annular surface 21. The radius of curvature $R_3$ of the annular surface 21 should be understood as extending from an imaginary circle 23 rather than a point in space. The radius of curvature $R_3$ of the annular surface 21 is smaller than the radius of curvature $R_1$ of the central surface 20. Consequently, $R_2>R_1>R_3$. The radius of curvature R3 of the annular surface 21 should preferably be chosen such that the value of $R_3$ is 4%-25% of the maximum value of the diameter $D_B$ of the bulb 10. By shaping the bulb 10 with an annular surface $R_3$ that has a smaller radius of curvature than the central surface 20, the transition between the curved central surface 20 and the rest of the bulb surface becomes smoother. The rest of the bulb surface can be described in terms of a tapering cylinder surface 25, i.e. a surface that to some extent resembles a conical surface. Consequently, the flow of water around the bulb 10 will be less disturbed when the rudder deviates from a neutral position. This improves the efficiency. The preferred range for $R_3$ of 4% to 25% of the maximum bulb diameter has been chosen to optimise efficiency at rudder angles up to 5°. At larger rudder angles, the improvement in efficiency is not so large but this is of little importance. The reason that the design should be optimised for rudder angles up to 5° is that rudder angles up to 5° is what can be expected during the major part of a sea voyage in commercial traffic. Rudder angles larger than 5° are seldom necessary outside the harbour.

Experiments performed by the inventors indicate that the best result can be expected when the radius $R_3$ of the annular surface 21 is about 25% of the maximum diameter $D_B$ of the bulb 10. In theory, the bulb 10 could of course be designed in such a way that the central surface 20 of the bulb end 11 extended without any discontinuity all the way to the area where the bulb 10 reaches its maximum diameter. However, this would in the majority of practical applications make the bulb 10 undesirably large. It is believed by the inventors that there would probably be no advantage in making the radius $R_3$ larger than 25% of the maximum bulb diameter since, in some cases, that could be detrimental to the close fit between the hub cal 13 and the bulb 10.

In realistic embodiments contemplated by the inventors, the radius $R_1$ of the bulb end 11 could be about 15-35% of the propeller diameter (typical propeller diameter may be 2-6 m) while the radius $R_2$ of the curved surface 19 of the hub cap 13 would be slightly larger, suitably 100 mm larger.

The design explained with reference to FIG. 11 and FIGS. 12*a* and 12*b* should preferably be combined with the technical solutions explained with reference to FIGS. 1-10. This will contribute to the object of improving efficiency. However, it should be understood that the technical features disclosed in FIGS. 11-12*b* could also be used independently of how the rudder arrangement is other wise designed.

The inventors have found that the inventive combination of the twisted rudder, the bulb and the propeller with the hub cap results in an improved efficiency. Test results have shown that efficiency can be increased by up to 5% when the inventive concept is used. This corresponds directly to a similar reduction of the fuel consumption. Depending on the precise circumstances of each individual application, it may be possible to increase the efficiency by more than 5%. It has also been found by the inventors that the manoeuvrability of the ship is improved.

For the part of the rudder and the bulb that is located upstream of the rudder stock 7 (i.e. closer to the propeller), the projected side area should preferably be 25%-30% of the total rudder area (including the projected area of the bulb 10). The inventors have found that, if the area of the rudder and bulb upstream of the rudder stock represents more than 30% of the total rudder area, this will result in a negative torque on the rudder. The rudder will then tend to turn away from the neutral position and a torque must be applied to prevent the rudder 6 from turning away from the neutral position. On the other hand, if the area upstream of the rudder stock 7 is less than 25% of the total rudder area, the rudder will have a very strong tendency to assume a neutral position. An unnecessarily high torque will then be required to turn the rudder 6. However, it is of course possible to envisage embodiments where the projected side area exceeds 30% of the total rudder area or is less than 25% of the total rudder area.

In realistic embodiments of the invention, the propeller would usually have a diameter in the range of 1.5 m-6 m. The propeller hub would typically have a diameter that is 25%-30% of the propeller diameter. For a propeller having a diameter of 6 m, the hub could then have a diameter in the range of 1.5 m-1.8 m. The rudder would usually have a height comparable to the diameter of the propeller.

While the invention has been explained above in terms of an arrangement for steering and propulsion of a ship, it should be understood that the invention can also be explained in terms of a ship provided with the inventive arrangement. The invention can also be explained in terms of a method for rebuilding a ship where the method comprises the steps that would necessarily be required in order to provide the ship with the inventive arrangement described above.

The invention claimed is:

1. A propulsion and steering arrangement for a ship (2), the arrangement comprising:

a) a rotary propeller (3) having a hub (5) and at least two propeller blades, b) a turnable rudder (6) arranged downstream of a propeller (3), c) on the rudder (6), a streamlined bulb (10) integral with the rudder (6), the bulb being separated from a propeller (3) by a gap (e) and d) a cap (13) on a propeller hub (5), the hub cap (13) bridging a gap (e) between the propeller (3) and the bulb (10)

characterised in that the rudder is twisted, in that a twist of the rudder is greatest in an area of the bulb (10) and decreases with a distance from the bulb (10) and in that a twist angle (β) at a certain distance from the bulb is smaller below the bulb than above the bulb.

2. An arrangement according to claim 1, wherein a maximum diameter of the bulb (10) is 1% -40% greater than a diameter of a propeller hub (5).

3. An arrangement according to claim 1, wherein the bulb (10) extends along an axis (15) parallel with or coaxial with an axis of rotation of a propeller (3).

4. An arrangement according to claim 1, wherein the bulb (10) extends along an axis (15) that defines an acute angle with an axis of rotation of a propeller (3).

5. An arrangement according to claim 4, wherein a rear end (16) of the bulb (10) is at a level above a front end of the bulb (10) and an angle between the bulb (10) and a propeller axis is 1°-14°.

6. An arrangement according to claim 1, wherein the hub cap (13) meets the bulb (10) at a location between a propeller (3) and a part of the bulb (10) where the bulb (10) reaches its maximum diameter.

7. An arrangement according to claim 1, wherein a twist of the rudder (6) decreases from a front end (8) adjacent a propeller (3) to a rear end (9) which is a distal end in relation to a propeller (3) such that a rear end (9) of the rudder (6) extends along a straight line.

8. An arrangement according to claim 1, wherein at least a part of the rudder (6) is continuously twisted from a front end (8) of the rudder (6) to a rear end (9) of the rudder.

9. An arrangement according to claim 1, wherein a twist of the rudder (6) decreases linearly with a distance from the bulb (10).

10. An arrangement according to claim 1, wherein the hub cap (13) and a front end of the bulb (10) are designed keep a distance between the bulb (10) and the cap (13) constant when the rudder (6) is turned.

11. An arrangement according to claim 1, wherein a maximum twist of the rudder (6) is 15°.

12. An arrangement according to claim 1, wherein the rudder (6) is twisted in different directions above and below the bulb (10).

13. An arrangement according to claim 1, wherein a part of the rudder (6) and the bulb (10) that is located upstream of a rudder stock (7) has a projected side area that is less than 30% of a total projected side area of the rudder (6) and the bulb (10).

14. An arrangement according to claim 10, wherein a forward end (11) of the bulb (10) has a central surface (20) with a radius of curvature ($R_1$) and the central surface (20) is surrounded by an annular surface (21) that has a radius of curvature ($R_3$) that is smaller than the radius of curvature ($R_1$) of the central surface (20) and is from 4% to 25% of a maximum bulb diameter ($D_B$).

15. A ship provided with an arrangement according to claim 1.

* * * * *